United States Patent [19]

Friedrichs

[11] 4,155,675

[45] May 22, 1979

[54] HYDRAULIC WALKING ROOF-SUPPORT FRAME

[75] Inventor: Hans-Otto Friedrichs, Wuppertal, Fed. Rep. of Germany

[73] Assignee: Hermann Hemscheidt Maschinenfabrik GmbH & Co., Wuppertal, Fed. Rep. of Germany

[21] Appl. No.: 918,604

[22] Filed: Jun. 23, 1978

[30] Foreign Application Priority Data

Jun. 30, 1977 [DE] Fed. Rep. of Germany ..... 2729564
Nov. 14, 1977 [DE] Fed. Rep. of Germany ..... 2750852

[51] Int. Cl.[2] ..... E21D 15/44
[52] U.S. Cl. ..... 405/291; 405/293
[58] Field of Search ..... 405/289, 290, 291, 292, 405/293, 294, 295, 296; 299/31-33; 91/170 MP

[56] References Cited

U.S. PATENT DOCUMENTS 3,885,396 5/1975 Snowden et al. ..... 405/296
3,898,845 8/1975 Plevak et al. ..... 405/296 X
3,915,500 10/1975 Schlusener et al. ..... 405/299

FOREIGN PATENT DOCUMENTS 2321233 11/1973 Fed. Rep. of Germany ..... 405/291
2302097 7/1974 Fed. Rep. of Germany ..... 405/295

*Primary Examiner*—Dennis L. Taylor
*Attorney, Agent, or Firm*—Berman, Aisenberg & Platt

[57] ABSTRACT

A hydraulic, walking, roof-support frame comprising a vertically-movable, pivotable control lever pivotally connected at its lower end portion to a rigid inextensible rocker arm pivotally mounted on a floor runner or skid of the frame and guided at a distance therefrom by a second rocker arm disposed nearer the coal-face end of the frame and pivotally connected to the floor runner and to the control lever, the free or coal-face end of the control lever being pivotally connected to a roof bar or plate pivotably born by hydraulic vertically-adjustable props, in which the said second rocker arm is longitudinally adjustable and is so constructed that it can be held at a predetermined intermediate length between pivots at its ends to enable its length to be changed in either direction as a result of a thrust from the roof.

7 Claims, 5 Drawing Figures

HYDRAULIC WALKING ROOF-SUPPORT FRAME

This invention relates to hydraulic walking roof-support frames as used in mines, especially coal mines.

It is already known to provide such a frame with an inclined shield having a bar or thick plate for supporting the roof at the coal face end, the height of the shield being adjustable in a vertical direction by hydraulic props which are pivotally mounted at their lower ends on a floor runner or skid, and the rear end portion of the shield being pivotably attached by a rocker arm to the floor runner. Pivotally connected to the rocker arm is an angle hydraulic cylinder which is likewise pivotally mounted on the floor runner so that the roof bar or plate, which moves over an arc with respect to the shield when the props are extended or retracted, can be adjusted with regard to its distance from the coal face by extension or retraction of the hydraulic cylinder.

Where fractures occur in the roof, shear forces act on the roof bar or plate of the set frame and are transmitted to the pivotal mountings of the shield. These forces may be extremely strong and break the pivots. In order therefore to protect these pivotal joints from overloading, it has been proposed in German Published Specification No. 23 14 834 that the two fluid-containing chambers of the angled cylinder used for pivoting the rocker arm should be protected by a pressure-limiting device, more particularly an excess-pressure valve system or a hydro-pneumatic pressure reservoir. By this means it is ensured that the pressure produced in the angled cylinder by a thrust from the roof can increase only up to a prescribed limit. If the set pressure is exceeded, the angled cylinder yields to the excessive pressure so that the pressure on the pivotal joints is relieved by pivotal movement of the shield.

In the case of an inclined shield of the kind described above, the distance between the roof bar and the coal face is adjustable. However, as the props are not usually set at one of their two end positions, the piston of the angled cylinder has to be brought into an undetermined intermediate position when the prop is set in order to bring the forward ends or tips of the bars to a given distance from the coal face. This depends on fine adjustment of hydraulic control means and also on the reliability and attention of the operators.

In order to facilitate control of such equipment, use is therefore made of guide means comprising a control lever which is guided in a vertically pivotable manner as the props are extended or retracted by two rigid rocker arms pivoted on the lower half of the control lever and on the floor runner at a distance from one another. If the pivots of the rocker arms are suitably disposed and the rocker arms have a suitable length, the free end of the control lever can be pivoted along a vertical path so that the roof bar connected thereto can be guided at a uniform distance from the coal face, irrespective of the length to which the props are extended.

The main aim of the present invention is to protect this control lever, guided as it is in a vertically pivotable manner by two rocker arms, from the effects of thrust by the roof.

According to the invention, a hydraulic, walking, roof-support frame comprises a vertically-movable, pivotable control lever pivotally connected at its lower end portion to a rigid inextensible rocker arm pivotably mounted on a floor runner or skid of the frame and guided at a distance therefrom by a second rocker arm disposed nearer the coal-face end of the frame and pivotally connected to the floor runner and to the control lever, the free or coal-free end of the control lever being pivotally connected to a roof bar or plate pivotably borne by hydraulic vertically-adjustable props, in which the said second rocker arm is longitudinally adjustable and is so constructed that it can be held at a predetermined intermediate length between pivots at its ends to enable its length to be changed in either direction as a result of a thrust from the roof.

The device according to the invention can stabilize an intrinsically-unstable walking roof-support frame. The tip of the bar or plate (assuming the frame is at a constant distance from the coal face) is kept at a uniform distance from the coal face, irrespective of the length to which the props are extended. Preferably the said second rocker arm nearer the coal-face side comprises a hydraulically-controlled, variable-length double-piston cylinder having a stroke length which is automatically adjusted to the distance between its pivotal axes corresponding to that required for the bar to rise vertically when the props are set. To this end, the cylinder is brought into an "intermediate-length" position in which one piston is extended and the other is retracted and the cylinder stroke can be varied in either direction. In this position, the hydraulically-actuated piston ends are each protected by a respective excess-pressure relief valve so that the cylinder yields to the roof shear forces and thus relieves the frame from unacceptable loads.

Two examples of roof-support frames in accordance with the invention are shown in the accompanying drawings, in which.

Figure 1:
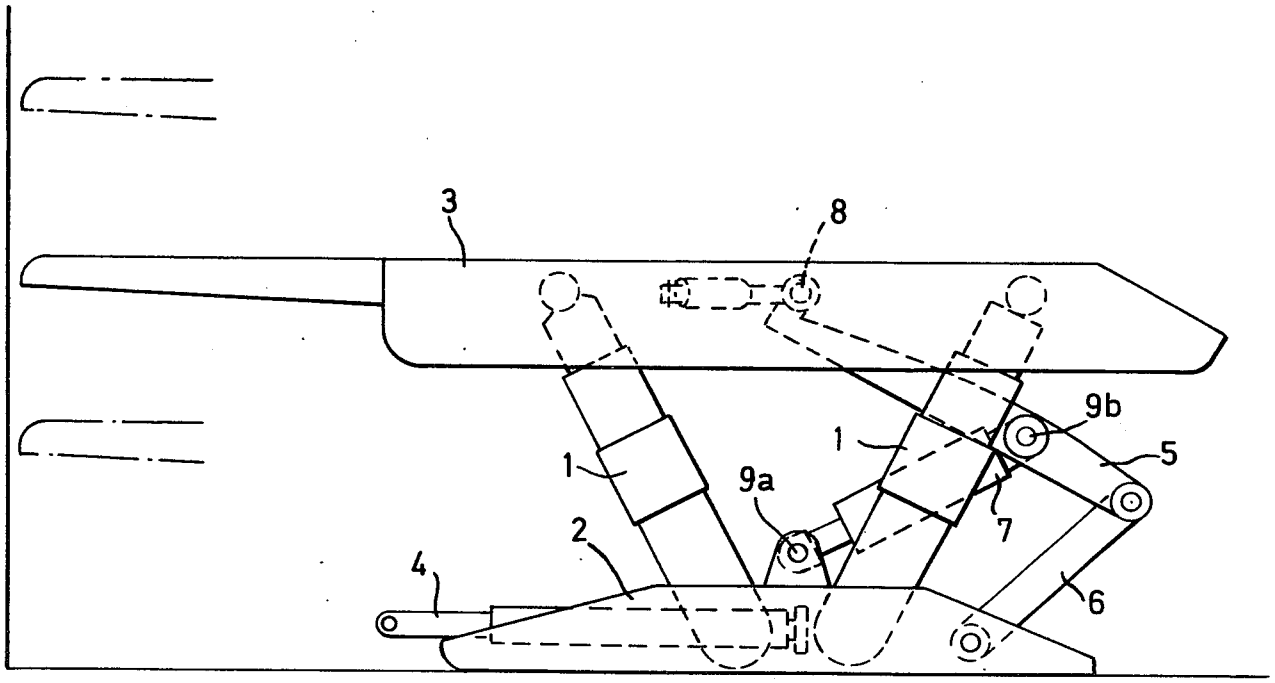
FIG. 1 is a side view of a hydraulic walking roof-support frame stabilized by one form of control-lever system according to the invention.
Figure 2:
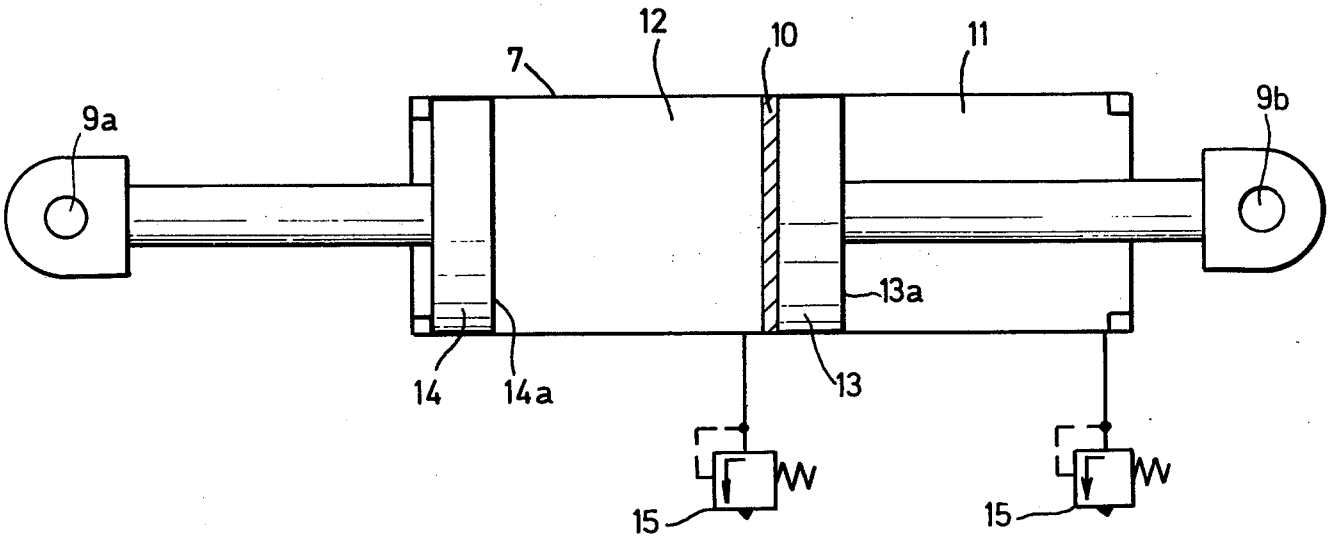
FIG. 2 is an enlarged cross-section through a double-piston cylinder forming part of FIG. 1 showing the position of the pistons therein when the props are set.

The device according to the invention is intended for stabilizing a trestle-like roof-support frame. The frame shown in FIGS. 1 and 2 comprises hydraulic vertically-adjustable props 1 which are pivotally mounted at their lower ends on a floor runner or skid 2 so as to be disposed in a V-configuration on the floor runner. At their upper ends, the props 1 pivotally support a roof bar or plate 3. The frame is moved by a pushing or traction device 4 which engages an abutment (not shown) and is secured to the floor runner 2.

The frame-stabilizing device comprises an inclined control lever 5 the lower end half of which is pivoted and guided by two rocker arms 6, 7 pivotably mounted on the floor runner 2. At its end nearer the coal face, the control lever 5 is secured to the roof bar or plate 3 by a ball-and socket pivotal joint 8. The rocker arm 6 at the extreme lower end of the lever 5 is rigid and nonextensible. On the other hand, the rocker arm 7 nearer the coalface which is secured to the runner 2 and the lever 5 at a distance spaced from the rocker arm 6 comprises a hydraulically-actuated variable-length double-piston cylinder comprising two stroke chambers 11, 12 (see FIG. 2) separated by a partition 10 and containing two pistons 13, 14 which can be moved with respect to one another.

When the props 1 are set, the annular surface 13*a* of piston 13 and the full surface 14*a* of piston 14 are subject to hydraulic pressure so that the cylinder 7 takes up an intermediate position from which the cylinder can be retracted or extended an equal distance as a result of a thrust from the roof after the props 1 have been set. In the intermediate position, the distance between the two pivotal axes 9*a* and 9*b* of the cylinder 7 corresponds exactly to the length required to allow the bar 3 to rise vertically when the props 1 are set. In the intermediate position, the hydraulically-actuated pistons 13 and 14 of the cylinder 7 are each hydraulically protected by a respective excess-pressure relief valve 15.

The invention is not limited to a device for stabilizing a trestle-like roof-support frame. It can also be applied to an hydraulic frame which is vertically adjustable by means of the rocker arms.

Figure 3:
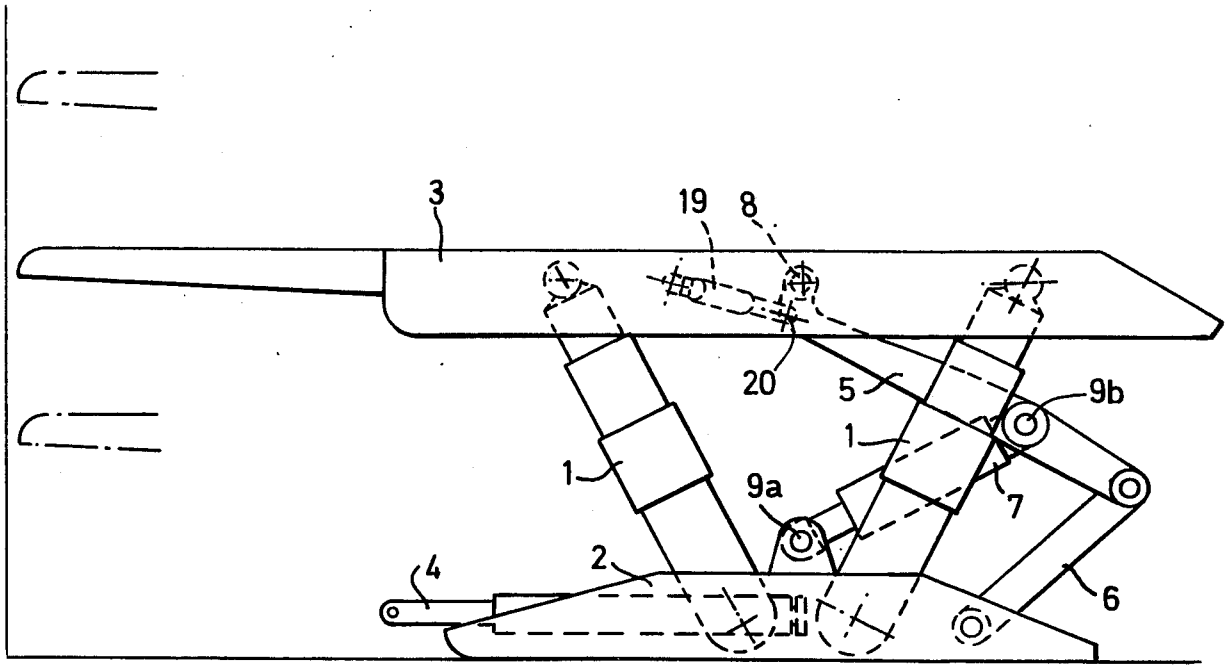
FIG. 3 is a side view of a second form of hydraulic walking roof-support frame comprising a stabilizing device according to the invention.
Figure 4:
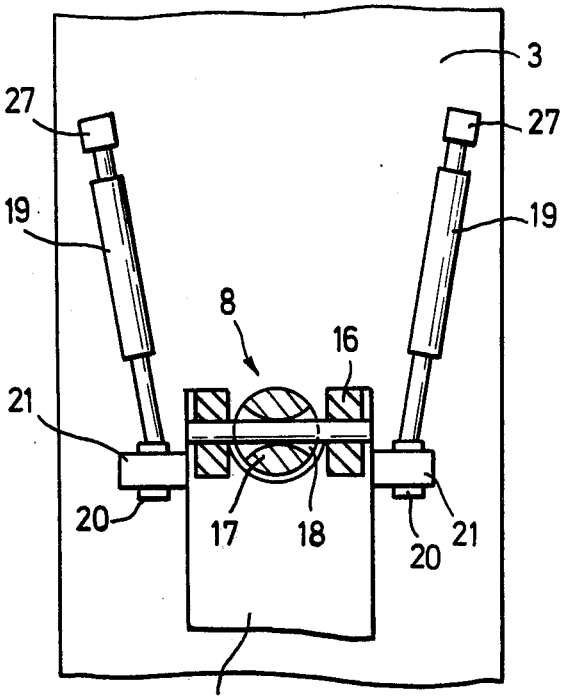
FIG. 4 is a plan view of the stabilizing device shown in FIG. 3 disposed at the underside of the roof bar of the roof-support frame.
Figure 5:
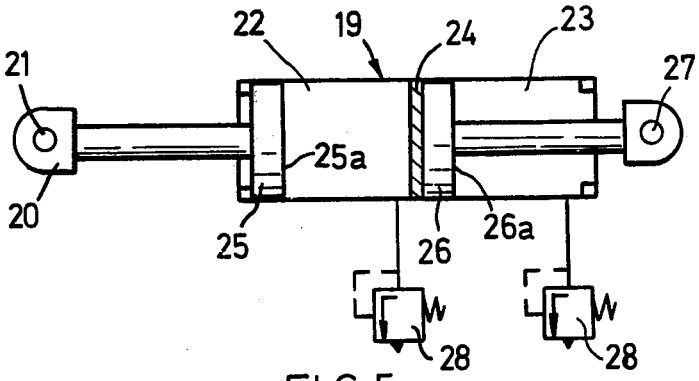
FIG. 5 is an enlarged cross-section through an aligning cylinder in the stabilizing device of FIG. 4 in the intermediate position which it occupies when the props are being set.

FIGS. 3 to 5 show a second form of roof-support frame having a device for stabilizing the roof bar or plate of the frame. In many respects, the frame of FIGS. 3 to 5 is identical or similar to that shown in FIGS. 1 and 2, but it also incorporates additional means for stabilizing the ball-and-socket pivotal connection between the upper free end of the control lever and the roof bar or plate.

It is already known in roof-support frames for the roof bar or plate to be stabilized against lateral tilting and twisting by vertically-adjustable guide devices mounted on the floor runner or skid and pivoted to the roof bar. For this purpose, use is made for example of double rocker arms pivotably mounted on the floor runner and a control lever pivoted to the bar or plate and vertically adjustable above the rocker arms, or of telescopically-extendable columns or props, mounted on the floor runner, which enable the bar or plate to move in such a way that it remains substantially parallel to the floor runner. Where, however, the control lever or columns are secured to the bar or plate by swivel joints having a transverse axis, there is a risk that the frame, when not braced against the roof, may tilt forwards or backwards, with the result that the swivel joint may be damaged if the bar or plate bears obliquely against the roof and is laterally tilted.

On the other hand, a ball-and-socket connection in place of such a swivel joint which can pivot in all directions has the disadvantages that the bar or plate can take up an unstable equilibrium position. Any change in equilibrium, caused, say, by non-uniformly extended props, will cause the bar or plate to rotate about the ball-and-socket connection and tilt the frame.

FIGS. 3 to 5 accordingly illustrate a frame where the bar or plate is mounted so as to be pivotable in all directions on the props of the frame while being stabilized in such a way that, when released, it can be secured in a given position, but is flexible when set. Those parts in FIGS. 3 to 5 which correspond to parts already described in FIGS. 1 and 2 have been given the same reference numerals as in FIGS. 1 and 2 and will not be described further. In the case of FIGS. 3 to 5, however, the upper free end of the control lever 5 is forked and has a universal joint shaft 16 extending through the fork and through the ball 17 of the ball-and-socket joint 8, the ball 17 having a through-aperture 18 which widens at both sides on the underside of the bar or plate 3. Two aligning cylinders 19 mounted in a V-configuration in the bar or plate 3 are pivoted at 20 on either side of the forked free end of the lever 5, namely, on projecting stub shafts 21. Each cylinder 19 is of similar construction to the cylinder 7 as will be seen from FIG. 5. Thus, each cylinder 19 is a double-piston cylinder having two stroke chambers 22, 23 separated by a partition 24 and containing two pistons 25, 26 which can move relatively to one another. The far ends of the two cylinders 10 are pivotally mounted on the bar 3 at 27.

When the props 1 are set, hydraulic fluid is supplied to the surface 25*a* of piston 25 and to the annular surface 26*a* of piston 26 in each cylinder 19. The length of each cylinder 19 is thus brought to an intermediate value which exactly corresponds to that at which the bar or plate 3 occupies a position parallel to the floor runner 2. In this position, when hydraulic fluid is supplied to the cylinders 19, the bar or plate 3 is braced with the lever 5 as a result of the pressure ratio between the points of articulation of the cylinders 10 and the point of rotation of the bar or plate 3. The hydraulically-actuated surfaces of the piston 25 and 26 are each protected by a respective pressure-limiting valve 28. If, when the props 1 are set, the bar or plate 3 comes into an oblique position, i.e. not parallel to the floor runner 2, one aligning cylinder 19 is retracted so that hydraulic fluid flows out of the cylinder through the corresponding pressure-limiting valve 28, while the other cylinder 19 is extended so as to correct position of the bar or plate 3 and bring it back into parallelism with the floor runner 2.

I claim:

1. A hydraulic, walking, roof-support frame comprising a floor runner adapted to skid along the floor of a mine, a rigid inextensible first rocker arm pivotally mounted on the floor runner, a vertically-movable, pivotable control lever pivotally connected at a lower end portion thereof to the said rocker arm, a second rocker arm disposed nearer the coal-face end of the frame than the first rocker arm and pivotally connected at spaced-apart locations to the floor runner and to the control lever, a plurality of hydraulic vertically-adjustable props extending upwards from, and connected to, the floor runner, and a roof bar pivotally borne by said props with the end of the control lever nearer to the coal-face end of the frame being pivotally connected to the roof bar, the second rocker arm being longitudinally adjustable and being so constructed that it can be held at a predetermined intermediate length between pivots at its ends to enable its length to be changed in either direction as a result of a thrust from the roof.

2. A hydraulic walking roof-support frame according to claim 1, in which the said second rocker arm comprises a hydraulically-controlled double-piston cylinder having two stroke chambers separated by a partition and containing two pistons which are movable with respect to one another.

3. A hydraulic walking roof-support frame according to claim 2, in which, when the props of the frame are set, an annular end surface of one piston and a full end surface of the other piston are actuated by hydraulic liquid, the said hydraulically-actuated ends of the pistons each being protected by a respective excess-pressure valve.

4. A hydraulic walking roof-support frame according to claim 2, in which each piston of the cylinder has substantially the same length of stroke.

5. A hydraulic walking roof-support frame according to claim 1 having the roof bar arranged to pivot on all sides on the props which are pivotably mounted on the floor runner or skid, and having a ball-and-socket connection between the upper free end of the control lever and the roof bar, there being a pair of converging aligning cylinders disposed in the roof bar and pivotally connected, one on each side, to the free end of the control lever so that, when the props are set, the aligning cylinders are adjustable to a length where they hold the roof bar in a position where it lies substantially parallel to the floor runner.

6. A hydraulic walking roof-support frame according to claim 5, in which each aligning cylinder has two stroke chambers separated by a partition and containing two pistons which are movable with respect to one another.

7. A hydraulic walking roof-support frame according to claim 6, in which, when the props are set, hydraulic pressure is exerted on the entire end surface of one piston and on an annular end surface of the other piston, the said hydraulically-actuated ends of the pistons each being protected by a respective pressure-limiting valve.

* * * * *